US007261675B2

(12) United States Patent
Kuo

(10) Patent No.: US 7,261,675 B2
(45) Date of Patent: Aug. 28, 2007

(54) STEPPING EXERCISER HAVING ACTUATABLE HANDLE

(76) Inventor: Hai Pin Kuo, No. 15, Lane 833, Wen Hsien Road, Tainan 70459 (TW)

( * ) Notice: Subject to any disclaimer, the term of this patent is extended or adjusted under 35 U.S.C. 154(b) by 287 days.

(21) Appl. No.: 11/131,784

(22) Filed: May 17, 2005

(65) Prior Publication Data

US 2006/0264301 A1 Nov. 23, 2006

(51) Int. Cl.
*A63B 22/04* (2006.01)

(52) U.S. Cl. ..... 482/52; 482/71

(58) Field of Classification Search ..... 482/51, 482/52, 53, 62, 114, 115, 118, 119, 126, 130; 601/23, 27, 29, 31–34, 40
See application file for complete search history.

(56) References Cited

U.S. PATENT DOCUMENTS 5,518,470 A * 5/1996 Piaget et al. ..... 482/51
5,540,637 A * 7/1996 Rodgers, Jr. ..... 482/52
5,577,985 A * 11/1996 Miller ..... 482/52
5,807,210 A * 9/1998 Devlin ..... 482/52
6,540,646 B2 * 4/2003 Stearns et al. ..... 482/52
6,595,899 B2 7/2003 Liang ..... 482/53
6,620,080 B1 * 9/2003 Gray ..... 482/52
6,679,813 B1 * 1/2004 Gray ..... 482/71
6,719,665 B1 * 4/2004 Lai ..... 482/52
7,097,600 B2 * 8/2006 Gray ..... 482/71
7,137,928 B1 * 11/2006 Chen ..... 482/53

* cited by examiner

*Primary Examiner*—Jerome Donnelly
*Assistant Examiner*—Tam Nguyen
(74) *Attorney, Agent, or Firm*—Charles E. Baxley

(57) ABSTRACT

A stepping exerciser includes a spindle rotatably supported on a base, a pair of foot pedals rotatably supported on the base and arranged to be moved up and down stepped upon by a user, a coupling device for coupling the foot pedals to the spindle, to drive and to rotate the spindle, a pair of handles rotatably supported on the base, and arranged to be rotated by the user, and a connecting device for connecting the handles to the spindle, to selectively drive and rotate the spindle. The spindle may thus be continuously driven by the foot pedals and the handles alternatively. One or more spring members or a wheel may apply a resistive force against the spindle.

12 Claims, 6 Drawing Sheets

STEPPING EXERCISER HAVING ACTUATABLE HANDLE

BACKGROUND OF THE INVENTION

1. Field of the Invention

The present invention relates to a stepping exerciser, and more particularly to a stepping exerciser having a weight or flywheel rotatable or drivable by the stepping exerciser, to provide a resistive force against the stepping exerciser.

2. Description of the Prior Art

Typical stepping exercisers comprise a pair of foot supports or foot pedals pivotally or rotatably attached on a base, and movable up and down, for conducting up and down stepping exercises. Normally, the foot supports or foot pedals may be moved up and down only, and may not be moved laterally and outwardly relative to the users.

U.S. Pat. No. 5,518,470 to Piaget et al., and U.S. Pat. No. 6,595,899 to Liang disclose two further typical stepping exercisers each comprising a pair of foot supports or foot pedals pivotally or rotatably attached on a base, and movable laterally and outwardly relative to the base and the users, for conducting other types of exercises, such as mountain climbing exercises, snow skiing exercises, etc.

However, the foot supports or foot pedals of the typical stepping exercisers may not be used to rotate or to drive a weight or a flywheel. In addition, the typical stepping exercisers have no handles to be moved or operated by the users to train the upper muscle groups of the users.

The present invention has arisen to mitigate and/or obviate the afore-described disadvantages of the conventional stepping exercisers.

SUMMARY OF THE INVENTION

The primary objective of the present invention is to provide a stepping exerciser including a weight or flywheel rotatable or drivable by the stepping exerciser, to provide a resistive force against the stepping exerciser.

The other objective of the present invention is to provide a stepping exerciser including a handle selectively actuatable or operatable by the users.

The further objective of the present invention is to provide a stepping exerciser including a spindle to be rotated or driven by both the foot pedals and the handles.

In accordance with one aspect of the invention, there is provided a stepping exerciser comprising a base, a spindle rotatably supported on the base, a pair of foot pedals rotatably supported on the base, and arranged to be moved up and down and stepped by a user, a coupling device for coupling the foot pedals to the spindle, to drive and to rotate the spindle, a pair of handles rotatably supported on the base, and arranged to be rotated by the user, and a connecting device for connecting the handles to the spindle, to drive and to rotate the spindle, and thus to allow the spindle to be rotated continuously by the handles and the foot pedals alternatively.

The coupling device includes two arms extended from the spindle, and pivotally coupled to the foot pedals with links. The foot pedals each includes an extension extended therefrom and pivotally coupled to the links, to allow the spindle to be rotated and driven continuously by the foot pedals.

The connecting device includes two rotary members attached onto the spindle, and two cables coupled between the rotary members and the handles. The base includes at least two pulleys rotatably disposed thereon, for engaging with the cables respectively, to allow the spindle to be rotated and driven continuously by the handles.

The base includes two posts extended upwardly therefrom to support the pulleys thereon respectively, and each of the posts includes a bracket disposed thereon, to rotatably support the pulleys thereon respectively. The base includes a hand grip secured between the posts, for supporting an upper portion of the user.

The rotary members each includes a spring member engaged thereon, and coupled between the rotary members and the base, to apply a resistive force against a rotational movement of the rotary members and the spindle. The spindle includes a follower secured thereon and rotated in concert with the spindle to increase a moment of inertia of the spindle.

The base includes a wheel rotatably disposed thereon and coupled to the follower, to apply a resistive force against the follower and the spindle. The base includes a retarding device provided thereon and disposed for applying a resistive force against the wheel.

The base includes two pairs of levers rotatably secured thereon, and pivotally coupled to the foot pedals, to form a parallelogrammic structure to stably support the foot pedal. The levers each includes an upper portion having a tube laterally extended therefrom, for rotatably securing the foot pedals thereto with pivot rods. The foot pedal each includes a frame attached to the bottom portion thereof, for rotatably securing to the tubes or the levers with the pivot rods respectively.

The base includes two studs extended upwardly therefrom, the levers are rotatably secured to the base and the studs with pivot axles, the pivot axles are parallel to a longitudinal axis of the base, to allow the levers to be moved sidewise and outwardly relative to the base. The tubes of the foot pedals are also preferably parallel to the longitudinal axis of the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
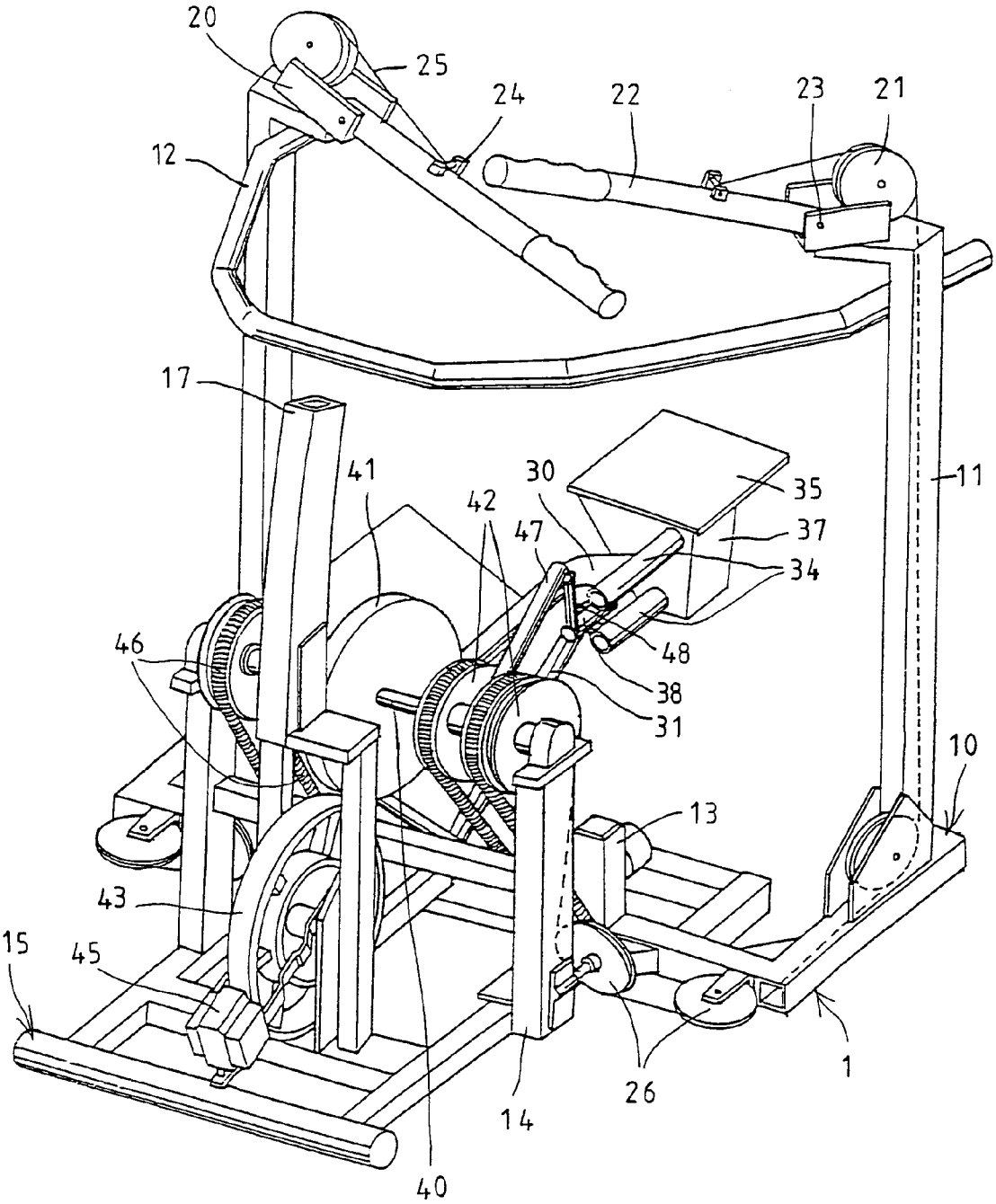
FIG. 1 is a partial front perspective view of a stepping exerciser in accordance with the present invention.

Referring to the drawings, and initially to FIGS. 1-5, a stepping exerciser in accordance with the present invention comprises a base 1 including a rear portion 10 having one or more, such as two posts 11 extended upwardly therefrom, and a hand grip 12 disposed or secured between the posts 11 (FIGS. 1, 3, 6), for supporting an upper portion of the user. Each of the posts 11 includes a bracket 20 attached or disposed or secured thereon, to rotatably support a wheel or a pulley 21 thereon, and a handle 22 rotatably or pivotally secured to the bracket 20 with a pivot pin 23, to allow the handles 22 to be rotated or pivoted relative to the bracket 20 and the posts 11 respectively.

Each of the handles 22 includes a coupler 24 disposed or secured thereon, to attach or to secure one end of a rope or cable 25 which may be engaged over the pulley 21, for allowing the cables 25 to be smoothly pulled by the handles 22 when the handles 22 are rotated relative to the bracket 20 and the posts 11 respectively. The base 1 may further include one or more wheels or pulleys 26 rotatably disposed or attached thereon, for engaging with the cables 25, or for allowing the cables 25 to be engaged onto or around the pulleys 26 respectively. The base 1 further includes two studs 13 extended upwardly from the rear portion 10 thereof.

One or more, such as two pairs of levers 30, 31 each has a lower portion rotatably or pivotally secured to the base 1 and/or the studs 13 with a pivot axle 32, which is parallel to a longitudinal axis A of the base 1 (FIG. 4), to allow the levers 30, 31 to be moved laterally and outwardly relative to the base 1. Each of the levers 30, 31 includes an upper portion 33 having a tube 34 laterally extended therefrom and also parallel to the longitudinal axis A of the base 1 (FIG. 4), for rotatably or pivotally securing a foot support or foot pedal 35 thereto with pivot rods 36.

Figure 5:
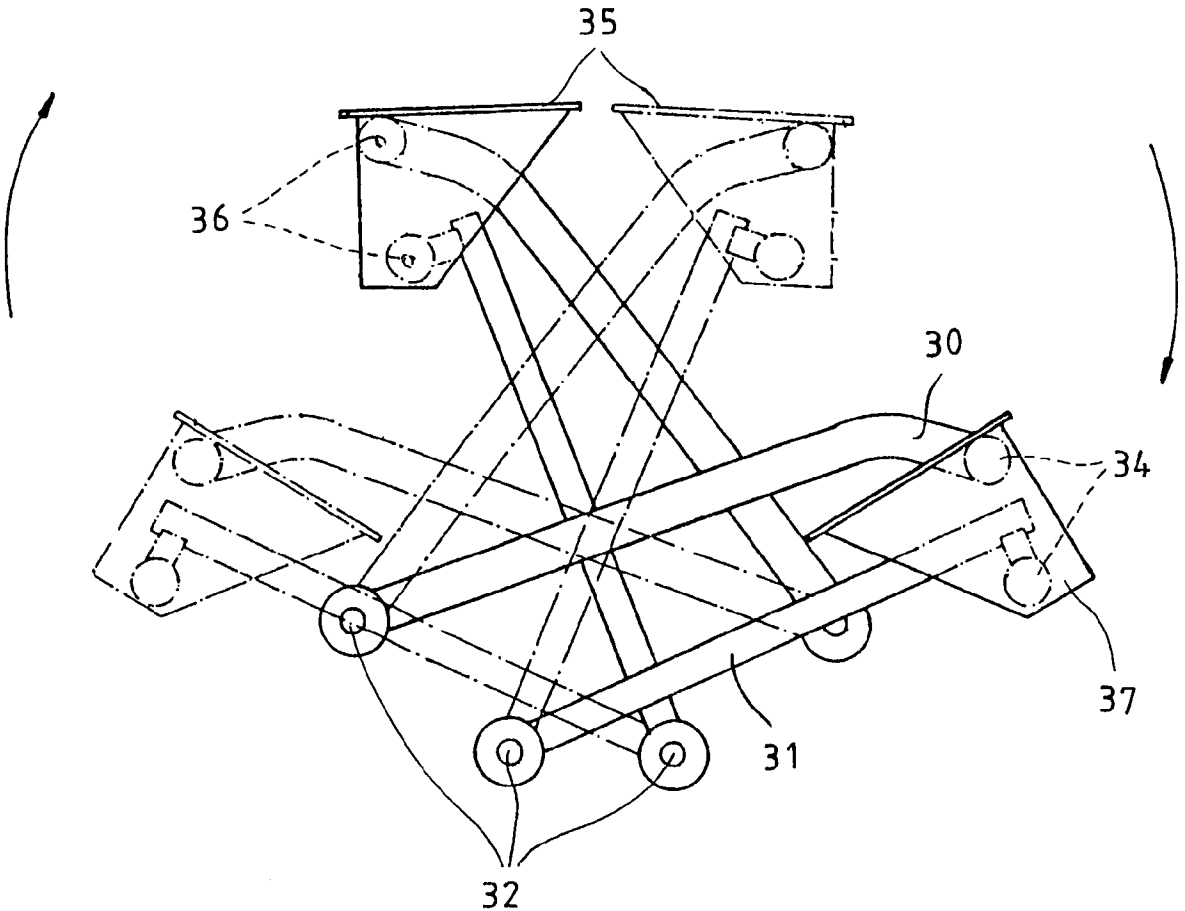
FIG. 5 is an enlarged partial rear plan view of the stepping exerciser.

For example, the foot pedal 35 each includes a frame 37 attached to bottom thereof, for rotatably or pivotally securing to the tubes 34 or the levers 30, 31 with the pivot rods 36, for allowing the foot pedal 35 also to be moved or rotated laterally or sidewise and outwardly relative to the base 1, best shown in FIG. 5. The levers 30, 31 may form a substantially-parallelogrammic structure for stably or suitably supporting the foot pedal 35 and thus the users, while the foot pedal 35 are stepped laterally or sidewise and outwardly relative to the base 1. An extension 38 is extended from each of the levers 30, 31, or from the foot pedals 35, or from the frame 37 of the foot pedals 35.

A spindle 40 is rotatably supported on the base 1 with one or more columns 14 that are extended upwardly from the base 1. A weight or follower 41 and two or more, such as four rotary members 42 are secured on the spindle 40 and rotated in concert with the spindle 40, to increase a moment of inertia of the spindle 40. A flywheel or wheel 43 may further be provided and rotatably supported on the front portion 15 of the base 1 and coupled to the follower 41 with a coupler member 44 (FIG. 2), such as a coupling chain, belt, or the like, to allow the wheel 43 to be rotated by the follower 41.

A brake or retarding device 45, such as an electromagnetic retarding device 45 may further be provided and disposed beside the wheel 43, for applying a resistive force against the wheel 43 and thus the follower 41 and the spindle 40. One or more, such as four resilient or spring members 46 may further be provided and have one end secured to and engaged onto or around the rotary members 42 respectively, and the other end engaged or secured to such as the base 1, to further apply a resistive force against the rotational movement of the rotary members 42 and thus the spindle 40 and the follower 41.

The cables 25 are engaged onto or around the pulleys 26 respectively, and are then engaged around two of the rotary members 42, for allowing the rotary members 42 and thus the spindle 40 and the follower 41 to be rotated or driven by the handles 22 when the handles 22 are rotated relative to the bracket 20 and the posts 11 by the users, such that the handles 22 may be operated against the retarding device 45 and the resilient or spring members 46, in order to exercise or to train the upper muscle groups of the users.

It is to be noted that the rotary members 42 are disposed on the spindle 40 with conventional unidirectional bearings (not shown) or the like, and arranged to allow the spindle 40 to be rotated or driven in an active direction by the rotary members 42, and to be rotated freely relative to the rotary members 42 in a reverse direction, and thus to allow the spindle 40 to be rotated or driven in the active direction continuously by the handles 22 alternatively. The retarding device 45 may also be provided to apply the resistive force against the handles 22 via the spindle 40 and the follower 41 and the wheel 43.

Figure 2:
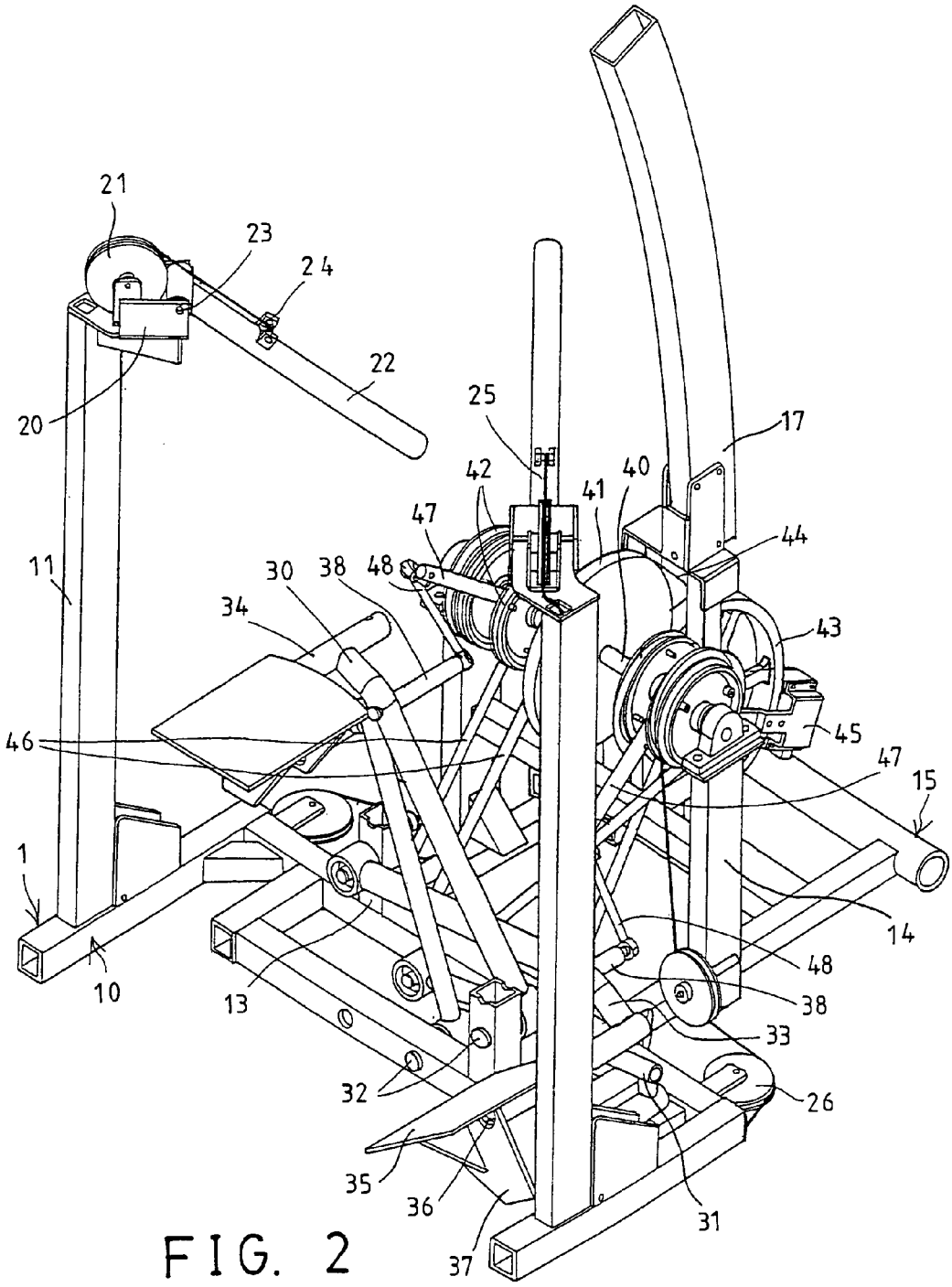
FIG. 2 is a partial rear perspective view of the stepping exerciser.
Figure 3:
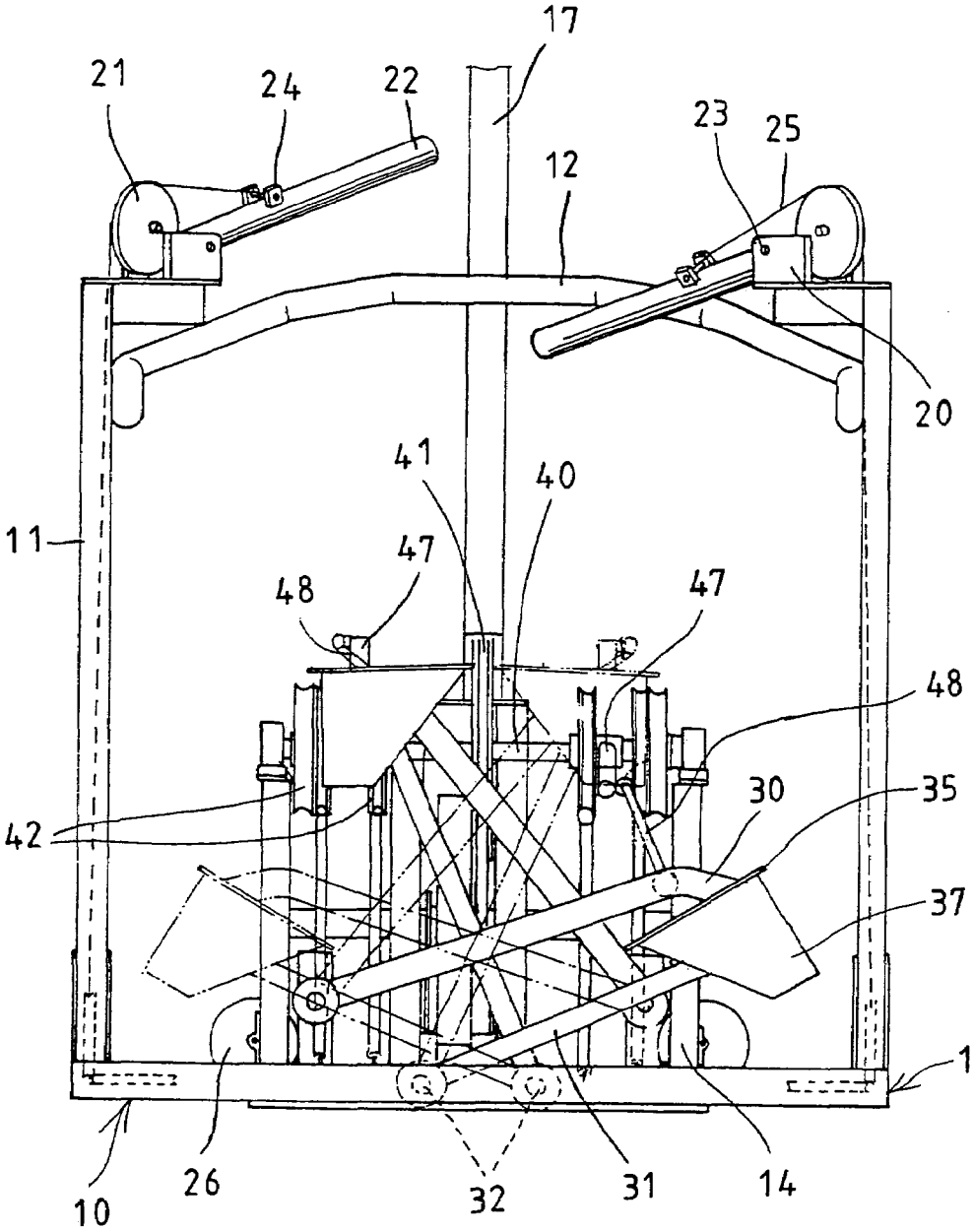
FIG. 3 is a partial rear plan schematic view of the stepping exerciser.
Figure 4:
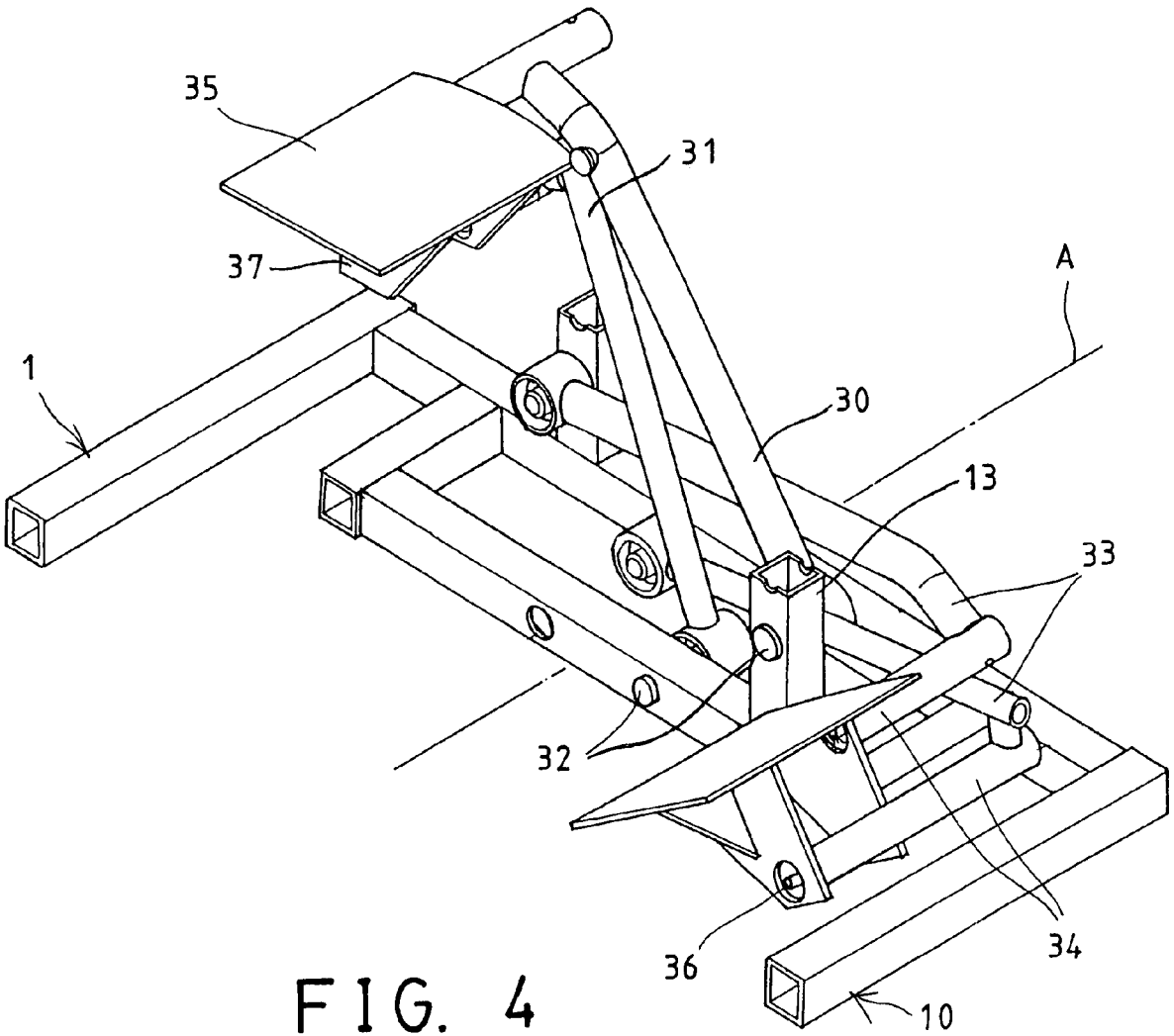
FIG. 4 is an enlarged partial rear perspective view of the stepping exerciser.

The spindle 40 further includes two arms 47 extended therefrom or coupled thereto, and pivotally coupled to the extensions 38 that are extended from the levers 30 or 31 respectively, with such as links 48, best shown in FIG. 2, to allow the spindle 40 to be rotated or driven continuously by the foot pedals 35 when the foot pedals 35 are stepped relative to the base 1 by the users, such that the foot pedals 35 may also be operated against the retarding device 45 and the resilient or spring members 46, in order to exercise or to train the lower muscle groups of the users.

In operation, the spindle 40 may be rotated or driven continuously by the foot pedals 35, and the rotary members 42 may also be rotated or driven by the handles 22 via the cables 25, such that the spindle 40 may be continuously rotated or driven by the foot pedals 35 and the handles 22 alternatively. The follower 41 and the wheel 43 may apply a resistive force against the spindle 40, and the resilient or spring members 46 may also be provided to apply a resistive force against the spindle 40.

The arms 47 extended from the spindle 40 and the extensions 38 extended from the levers 30 or 31 and the links 48 may thus be used or formed as a coupling means or device for coupling the foot pedals 35 to the spindle 40, to allow the spindle 40 to be rotated or driven continuously by the foot pedals 35. In addition, the rotary members 42 attached onto the spindle 40 and the cables 25 may thus be used or formed as a connecting means or device for connecting the handles 22 to the spindle 40, and thus to allow the spindle 40 to be rotated or driven continuously by the handles 22.

Figure 6:
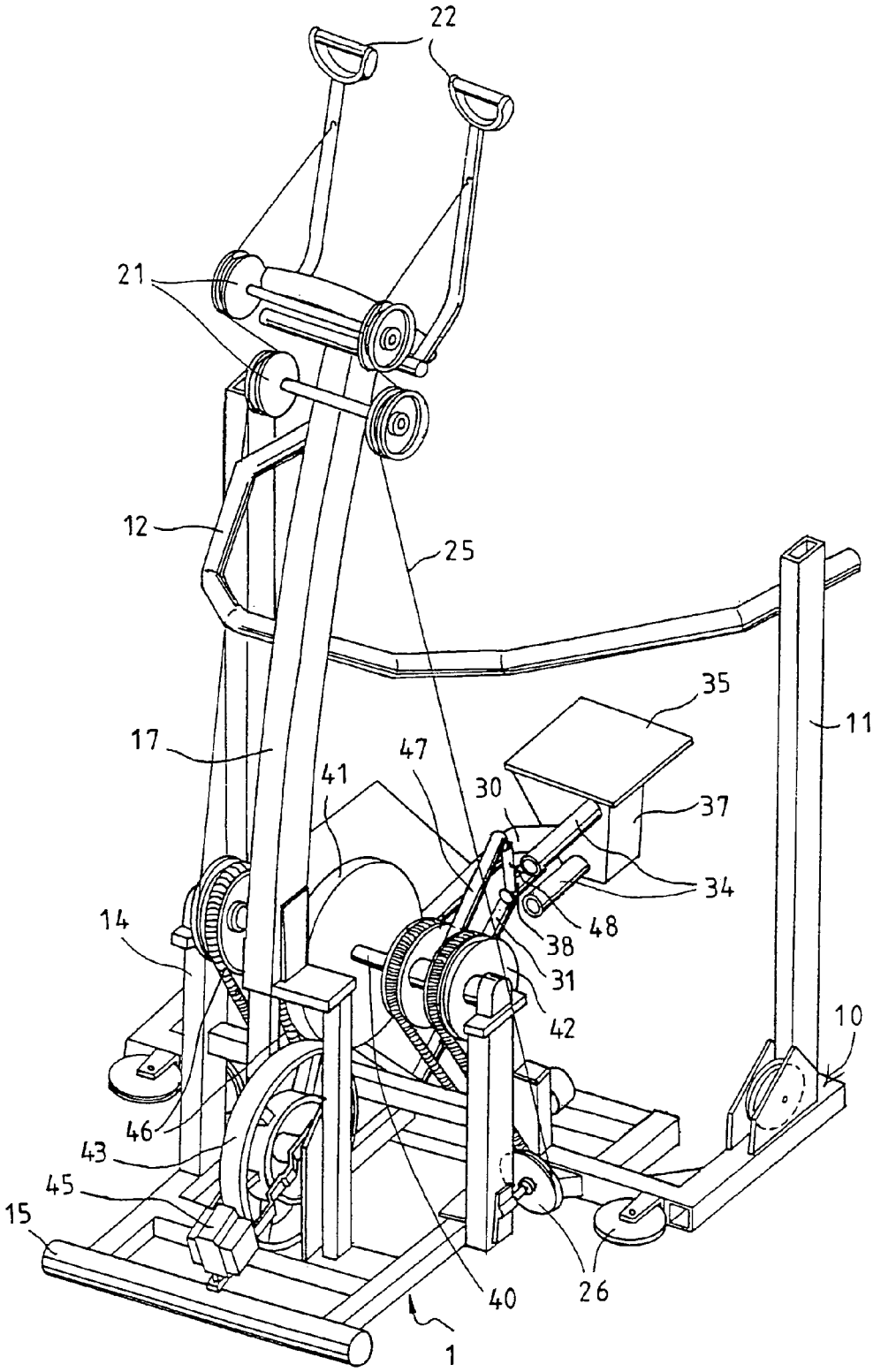
FIG. 6 is a front perspective view similar to FIG. 1, illustrating the other arrangement of the stepping exerciser.

As shown in FIG. 6, the base 1 may further include a pole 17 extended upwardly from the front portion 15 thereof, and the handles 22 may be rotatably attached or secured on top of the pole 17, and coupled to the rotary members 42 via the cables 25, to allow the rotary members 42 and thus the spindle 40 to be rotated or driven continuously by the handles 22 via the cables 25. Accordingly, the handles 22 that are rotatably attached or secured on top of a single pole 17 or attached on two posts 11 respectively may all be operated by the users to rotate and to drive the spindle 40 continuously.

Accordingly, the stepping exerciser in accordance with the present invention includes a weight or flywheel rotatable or drivable by the stepping exerciser, to provide a resistive force against the stepping exerciser, and includes a handle selectively actuatable or operatable by the users, and includes a spindle to be rotated or driven by both the foot pedals and the handles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base, adapted to rest upon a horizontal surface, having a longitudinal axis that divides the base into an equal right side and left side, a spindle rotatably supported on the base, a pair of handles rotatably supported on the base and arranged to be rotated by a user, means for connecting the handles to the spindle to drive and rotate the spindle, two arms, spaced a distance from each other, extending perpendicularly from the spindle, and a pair of foot pedals rotatably supported on the base to move in an arcuate motion up and down, toward and away from the longitudinal axis wherein the foot pedals are pivotally coupled to the arms via links to drive and rotate the spindle when the pedals are stepped upon by the user, the connecting means include two rotary members attached on the spindle and two cables coupled between the rotary members and the handles, the base includes at least one pulley rotatably disposed on the right side and at least one pulley rotatably disposed on the left side for engaging the cables respectively and the base also includes two pairs of levers rotatably secured thereon and pivotally coupled to the foot pedals to form a parallelogrammic structure to stably support the foot pedals.

2. The stepping exerciser as claimed in claim 1, wherein said base includes two posts extended upwardly therefrom to support said at least two pulleys thereon respectively, and each of said posts includes a bracket disposed thereon, to rotatably support said at least two pulleys thereon respectively.

3. The stepping exerciser as claimed in claim 2, wherein said base includes a hand grip secured between said posts, for supporting an upper portion of the user.

4. The stepping exerciser as claimed in claim 1, wherein said rotary members each includes a spring member engaged thereon, and coupled between said rotary members and said base, to apply a resistive force against a rotational movement of said rotary members and said spindle.

5. The stepping exerciser as claimed in claim 1, wherein said spindle includes a follower secured thereon and rotated in concert with said spindle to increase a moment of inertia of said spindle.

6. The stepping exerciser as claimed in claim 5, wherein said base includes a wheel rotatably disposed thereon and coupled to said follower, to apply a resistive force against said follower and said spindle.

7. The stepping exerciser as claimed in claim 6, wherein said base includes a retarding device provided thereon and disposed for applying a resistive force against said wheel.

8. The stepping exerciser as claimed in claim 1, wherein said levers each includes an upper portion having a tube laterally extended therefrom, for rotatably securing said foot pedals thereto with pivot rods.

9. The stepping exerciser as claimed in claim 8, wherein said foot pedal each includes a frame attached to a bottom thereof, for rotatably securing to said tubes with said pivot rods respectively.

10. The stepping exerciser as claimed in claim 1, wherein said base includes two studs extended upwardly therefrom, said levers are rotatably secured to said base and said studs with pivot axles, said pivot axles are parallel to the longitudinal axis of said base, to allow said levers to be moved sidewise and outwardly relative to said base.

11. The stepping exerciser as claimed in claim 1, wherein two extensions are extended from said levers and pivotally coupled to said arms of said spindle with said links respectively.

12. The stepping exerciser as claimed in claim 1, wherein said spindle includes two rotary members attached thereto and rotated in concert with said spindle, said rotary members each includes a spring member engaged thereon, and coupled between said rotary members and said base, to apply a resistive force against a rotational movement of said rotary members and said spindle.

* * * * *